US006324795B1

(12) United States Patent
Stiles et al.

(10) Patent No.: US 6,324,795 B1
(45) Date of Patent: Dec. 4, 2001

(54) SEISMIC ISOLATION SYSTEM BETWEEN FLOOR AND FOUNDATION COMPRISING A BALL AND SOCKET JOINT AND ELASTIC OR ELASTOMERIC ELEMENT

(75) Inventors: Harold L. Stiles, Vallejo; Knud B. Pedersen, Livermore; Shyam N. Shukla, Fremont, all of CA (US)

(73) Assignee: Ever-Level Foundation Systems, Inc., San Rafael, CA (US)

( * ) Notice: Subject to any disclaimer, the term of this patent is extended or adjusted under 35 U.S.C. 154(b) by 0 days.

(21) Appl. No.: 09/449,286

(22) Filed: Nov. 24, 1999

(51) Int. Cl.[7] ..... E04B 1/98
(52) U.S. Cl. ..... 52/167.4; 52/167.7; 52/167.9
(58) Field of Search ..... 52/167.4, 167.7, 52/167.9, 299

(56) References Cited

U.S. PATENT DOCUMENTS

| | | | | |
|---|---|---|---|---|
| 1,158,932 | | 11/1915 | Kohl . | |
| 2,597,800 | * | 5/1952 | Hussman | 52/167.7 X |
| 3,347,002 | | 10/1967 | Penkuhn . | |
| 4,188,681 | | 2/1980 | Tada et al. . | |
| 4,320,549 | | 3/1982 | Greb . | |
| 4,503,710 | | 3/1985 | Oertle et al. . | |
| 4,644,714 | | 2/1987 | Zayas . | |
| 4,962,668 | | 10/1990 | Preston et al. . | |
| 5,014,474 | * | 5/1991 | Fyfe et al. | 52/167.9 X |
| 5,071,261 | | 12/1991 | Stuve . | |
| 5,156,494 | | 10/1992 | Owens et al. . | |
| 5,452,548 | | 9/1995 | Kwon . | |
| 5,456,047 | * | 10/1995 | Dorka | 52/167.4 |
| 5,568,705 | | 10/1996 | Bellavista . | |
| 5,904,010 | | 5/1999 | Javid et al. . | |
| 5,970,666 | | 10/1999 | Kurabayashi et al. . | |

FOREIGN PATENT DOCUMENTS

| | | | | |
|---|---|---|---|---|
| 19836763 A1 | | 7/1999 | (DE) | E04H/9/02 |
| 0894900 A1 | | 2/1999 | (EP) | E02D/27/12 |
| 1260137 | * | 10/1989 | (JP) | 52/167.4 |
| 3013637 | * | 1/1991 | (JP) | 52/167.7 |
| WO 99/09278 | | 2/1999 | (WO) . | |

* cited by examiner

*Primary Examiner*—Carl D. Friedman
*Assistant Examiner*—N. Slack
(74) *Attorney, Agent, or Firm*—Scott W. Hewett

(57) ABSTRACT

A seismic isolation system with a plurality of ball-and-socket joints attaching a base structure to a plurality of foundation pads or piers. A plurality of pads or piers 3, 13 form a foundation structure. A seismic isolation bearing 20 attaches a pad to the floor 1 of a building or other structure. The seismic isolation bearing includes a joint 22 attached to an elastic element 12. The seismic isolation bearing allows tilting of the pad in relation to the base structure in response to vertical movement of a foundation pad. Additionally, rotation of the joint works in conjunction with the elastic element to reduce the shear deformation in the elastic element in response to transverse movement of the foundation pad.

11 Claims, 6 Drawing Sheets

SEISMIC ISOLATION SYSTEM BETWEEN FLOOR AND FOUNDATION COMPRISING A BALL AND SOCKET JOINT AND ELASTIC OR ELASTOMERIC ELEMENT

CROSS REFERENCES TO RELATED APPLICATIONS (none)

STATEMENT AS TO RIGHTS TO INVENTIONS MADE UNDER FEDERALLY SPONSORED RESEARCH AND DEVELOPMENT (none)

BACKGROUND OF THE INVENTION

This invention relates generally to seismic isolation bearings, and more particularly to a seismic isolation device providing an articulating joint.

Many inhabited areas are subject to earthquakes and other seismic activity. Building designs have been developed to limit the property damage, injury, and death due to earthquakes. One approach is to make buildings in seismic areas strong enough to withstand the greatest anticipated strain. Unfortunately, this approach can greatly increase both the material cost and construction cost of the building, and result in a very heavy building. A heavy building can further complicate matters if the building must be placed on a soft or meta-stable ground, like mud or fill. While such ground provides adequate support for the building during normal times, the meta-stable ground may provide reduced support during an earthquake, resulting in the foundation or a portion of the foundation sinking or tilting.

Other approaches have focused on isolating the building (structure) from the foundation and underlying soil that the building rests on. For example, techniques have been developed to allow a structure to slide relative to its foundation. Some devices include a joint with a sliding foot that allows a building to remain vertical as the foot slides. Unfortunately, while a sliding joint may avoid catastrophic failure of the building superstructure, after an earthquake the building may no longer be on its foundation, or the foundation may no longer be level. Other techniques provide an elastomeric bearing that allows some degree of elastic movement between the structure and the foundation. Elastomeric techniques typically focus on allowing shear deformation, that is, the relative movement of the building and foundation in a horizontal plane in response to an earthquake.

One approach to using elastic bearings provides a laminated structure of elastomeric material, such as rubber, interleaved with metal shims. The laminate structure confines the elastomer layers to limit horizontal expansion due to vertical load stresses while allowing shear deformation of the laminate stack in the result of an earthquake. Such laminates do not provide significant compliance for vertical strain, such as may accompany surface waves or tilting, and generally require a high degree of shear deformation, which generally means using an elastomeric material with a high degree of elasticity and/or many laminations.

Therefore, it is desirable to provide seismic isolation between a building and a foundation with improved compliance, including compliance in the vertical plane and tilting. It is further desirable that the seismic isolation be compatible with buildings built on meta-stable ground.

SUMMARY OF THE INVENTION

An apparatus for joining a building superstructure to a foundation has a joint allowing the foundation to tilt relative to the building superstructure. In a further embodiment, the apparatus includes an elastic element coupled to the joint to further facilitate accommodation of shear strain and other strains resulting from a seismic event. The joint is, for example, a ball and socket joint, and the elastic element is a block of elastomeric material allowing deformation along at least two orthogonal axis. The tilting of the building relative to the foundation allowed by the joint works in conjunction with deformation of the elastic element to accommodate both vertical motion and horizontal (shear) motion of the foundation. By tilting, the joint reduces the shear deformation in the elastomeric element that is required in response to a seismic event or other movement of the foundation relative to the building superstructure.

DESCRIPTION OF SPECIFIC EMBODIMENTS

I. Introduction

The present invention provides a seismic isolation device with an articulating joint, such as a ball-and-socket joint, and a system for constructing a seismically isolated building on a foundation, the foundation working in concert with seismic isolation devices and a floor structure of building. For purposes of this application and ease of explanation, the "building" is the superstructure that is typically built on a foundation. The foundation includes a number of foundation pads, such as concrete pedestals, poured-in-place concrete columns, concrete piers, or wooden piers. The articulating joint rotates to allow the building to tilt relative to an associated foundation pad when the foundation pad moves relative to the building. Each foundation pad can move at least partially independently from the others, thus allowing action of each isolation device at least partially separate from the other devices.

In a further embodiment, an elastomeric element or elements works in conjunction with the articulating joint of the seismic isolation device. The rotational movement of the joint allows the elastomeric element to absorb shear strain by deforming in a direction normal to the shear, as well as in a direction parallel to the shear. Thus, the elastomeric element efficiently absorbs strain. The elastomeric element further provides a restoring force to the joint, facilitating recovery to the original relationship between the building and the foundation.

II. Articulating Seismic Isolation Device

Figure 1A:
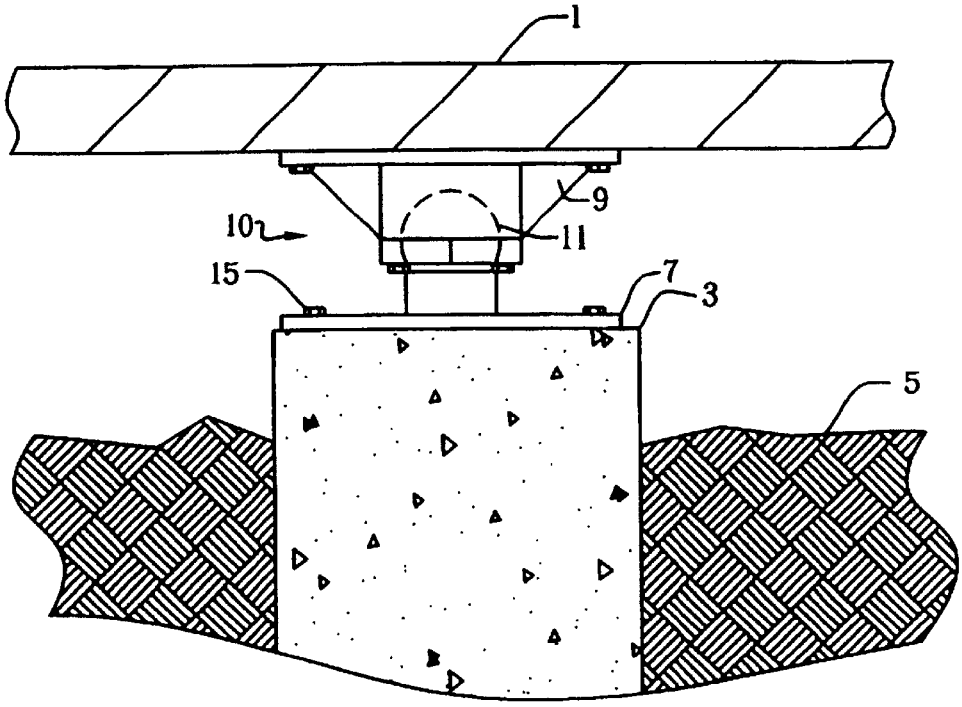
FIG. 1A is a simplified side view of a seismic isolation device and sections of a floor beam and foundation pad.

FIG. 1A is a simplified side view of a seismic isolation device 10 attached to a floor beam 1 and a foundation pad 3. The foundation pad is a reinforced concrete pad, concrete column, or pier of metal, concrete, or wood, or similar structure. The seismic isolation device includes a first portion 7 and a second portion 9, including mounting plates, connected by a joint 11. The joint is, for example, a ball-and-socket joint that allows rotational movement between the foundation pad 3 and the floor beam 1 in a plurality of directions, such as twisting and tilting. The first portion 7 is rigidly attached to the foundation pad 3, and the second portion 9 is rigidly attached to the floor beam 1, as with bolts 15, anchors, or studs. Thus the floor beam does not laterally move in relation to the second portion of the joint.

Figure 1B:
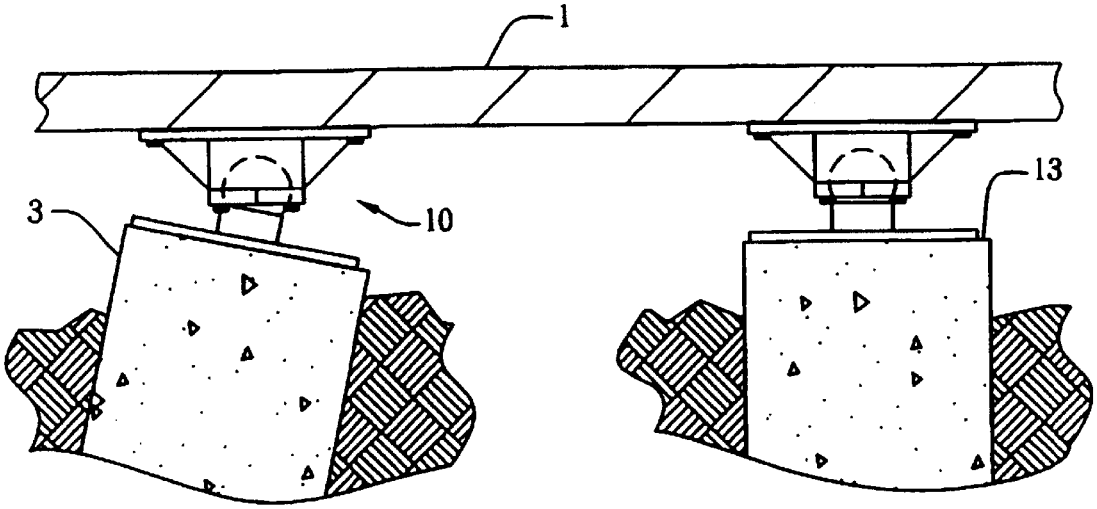
FIG. 1B is a simplified side view of two seismic isolation devices attached to a floor beam and respective foundation pads wherein one of the foundation pads has tilted.

FIG. 1B is a simplified side view of seismic isolation devices 10 attached to a floor 1 when one foundation pad 3 is tilted with respect to another foundation pad 13, such as in a surface wave of an earthquake. It is understood that the figures are not drawn to scale, and that the elements of the joint, i.e. the ball portion and the socket portion, may be inverted from what is shown in these figures. Additionally, "upper" is a term of convenience used to describe the relative position of elements in the figures, and not necessarily the position in actual use.

Figure 2A:
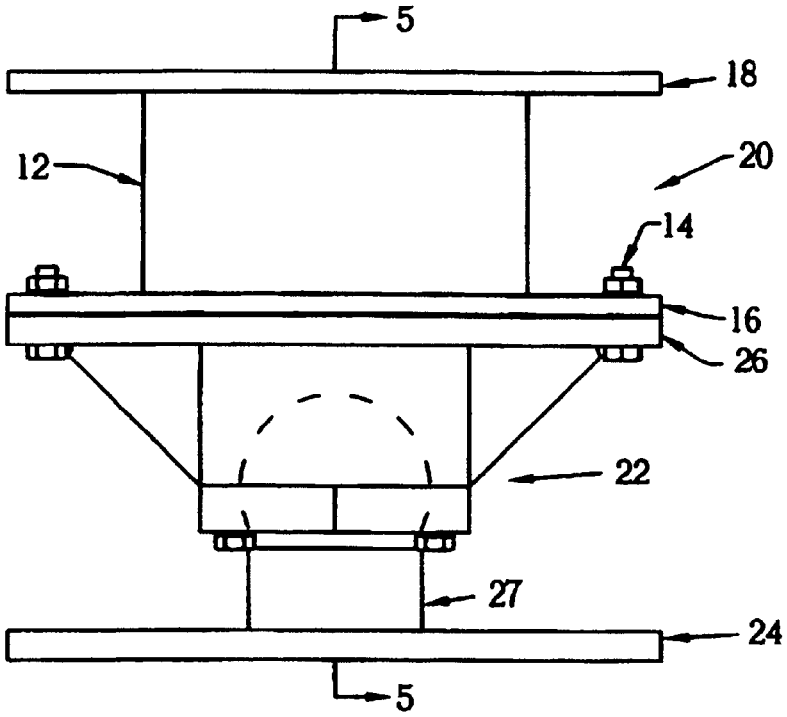
FIG. 2A is a simplified side view of a seismic isolation device according to an embodiment of the present invention.

FIG. 2A is a simplified side view of an embodiment of a seismic isolation device 20 according to the present invention that includes an elastomeric element 12 in conjunction with a joint member 22. The seismic isolation device is configured to be bolted or otherwise connected to a foundation pad and a floor beam, for example. It is understood that the seismic isolation device may be connected to a structure other than a floor beam. Similarly, the floor might be a reinforced concrete pad, without beams, for example.

The elastomeric element 12 is made of an elastomeric material, such as natural rubber, butyl rubber, isoprene rubber, polyurethane rubber, acrylic rubber, or similar material, with or without inserts, such as interleaved metal sheets or fibers. The durometer, modulus, elasticity, and strength of the elastomeric material is selected in view of the cross section and thickness of the elastomeric element to support a selected load and to accommodate the design displacement (discussed below). Of course, the elastomeric element may support a maximum operating load much higher than the selected load, which is typically the case so that a standardized seismic isolation device can be used in a variety of applications, each application having an operating load less than the maximum load of the seismic isolation device.

The elastomeric element 12 is vulcanized to mounting plates 16, 18, which are steel plates about 12 mm (0.5 in.) thick, drilled to accept bolts (not shown) that attach the seismic isolation device to the floor beam and a flange 26 of the joint member 22. The joint member 22 has a base 24 to attach the seismic isolation device to a foundation pad, for example. The elastomeric element may be attached to mounting plates in other fashions, such as with an epoxy adhesive, with or without mechanical attachment, such as bolts. It is contemplated that other materials and thickness could be used, according to the design load, design displacement, number of isolation devices used, and other factors.

Figure 2B:
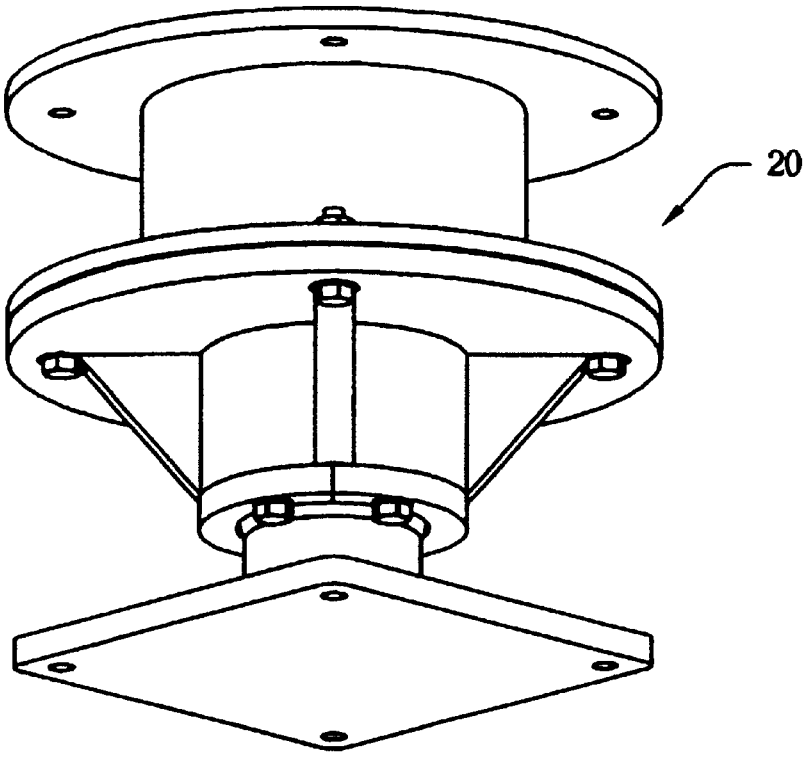
FIG. 2B is a simplified isometric view of the seismic isolation device shown in FIG. 2A.

In a preferred embodiment, the elastomeric element 12 is circular in cross-section, with a diameter of about 280 mm (11 in.), about 152 mm (6 in.) thick, and is made from an elastomer designed for an axial load of about 16,000 kg (36 kips), a lateral load of 2,000 kg (5 kips), a lateral displacement of 4.6 cm (1.8 in.), a lateral shear stiffness of about 490 kg/cm (2.75 kips/in.), a rotational capacity of 0.14 radians with a rotational stiffness of about 133,000 nt-m/rad. (1180 kip-inches/rad.), a vertical strain due to axial load of about 10%, and an equivalent viscous damping of 8–10%. These values are given as examples only, according to a specific embodiment of the present invention. FIG. 2B is a simplified isometric view of the seismic isolation device shown in FIG. 2A.

Figure 2C:
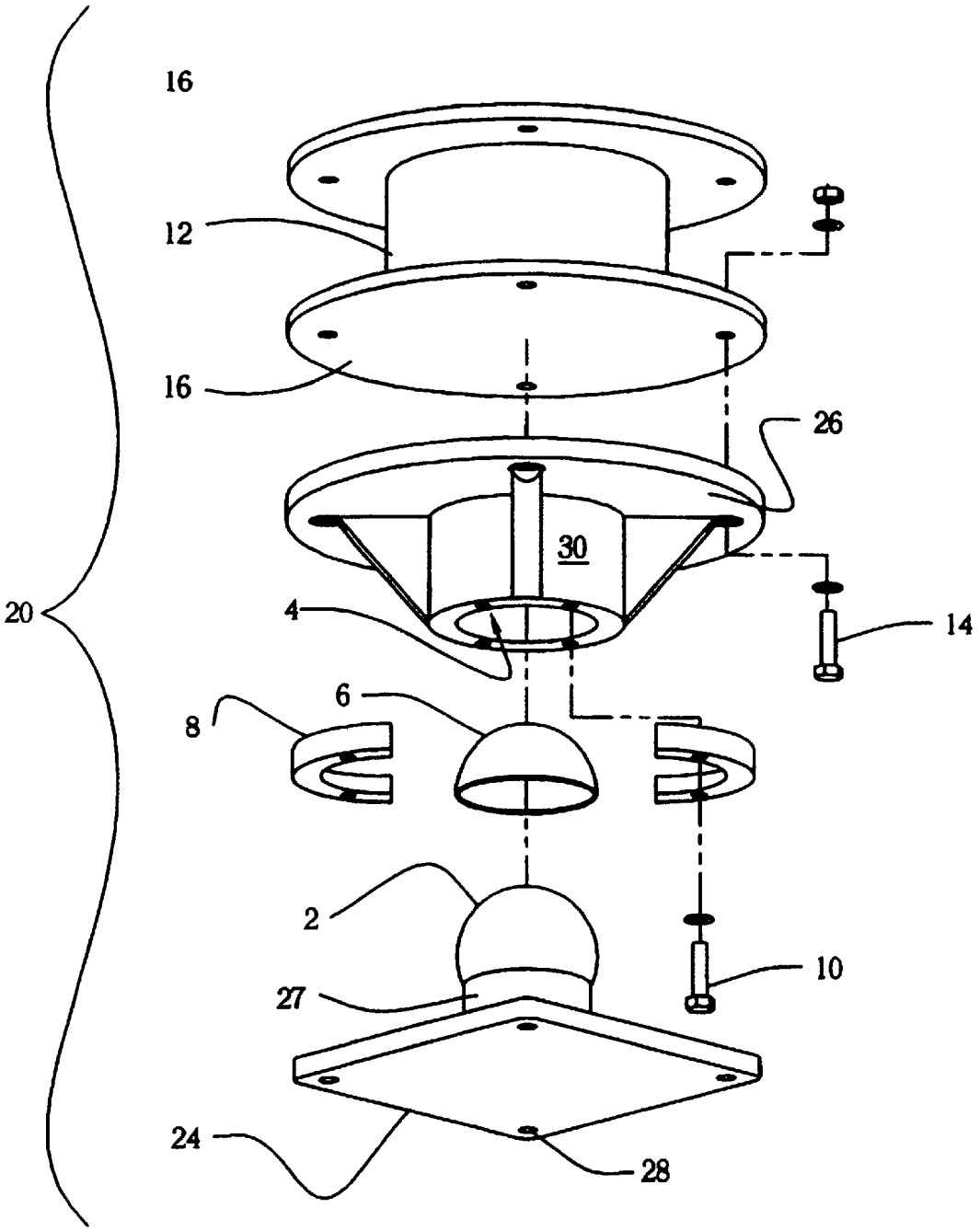
FIG. 2C is a simplified exploded view of the seismic isolation device shown in FIG. 2A.

FIG. 2C is a simplified exploded view of the seismic isolation device shown in FIG. 2A. The ball unit 2 is slightly more than hemispherical, and provides support for the building in conjunction with the mating socket 4. The ball 2 is attached to the base 24 with a neck 27. The length of the neck is chosen in conjunction with other dimensions of the joint to allow the socket to rotate about the ball through any angle imposed by the design displacement. The base 24 includes holes 28 for attaching the base to the foundation pad or floor with bolts or studs, for example. In a preferred embodiment, the ball, neck, and base are cast in one piece.

Similarly, the socket 4, body 30, and flange 26 of the upper portion of the joint assembly is cast as one piece. A split retainer 8 is attached to the body 30 with bolts 10, and allows the ball 2 to rotate relative to the socket 4, while retaining the ball in the socket, when the joint is assembled. The joint is lubricated with grease or other lubricant, and in a farther embodiment the joint member includes a friction-reducing insert 6 between the ball and the socket. The friction-reducing insert is, for example, a sheet of polymer such as polytetrafluoroethelyene or a lubricant-impregnated porous matrix. The lubricant may further include corrosion-reducing agents.

The elastomeric element 12 is vulcanized to a first plate 18 and a second plate 16. The elastomeric element 12 is shown as a uniform body, but may include internal structure, such as plates, fibers, voids, or other features intended to provide the elastomeric element with the desired mechanical properties, or for other purposes, such as a reduction in manufacturing cost. In a particular embodiment, tensile elements (not shown), such as fibers, in the elastomeric element limit the separation between the first and second plate, or at least increase the modulus of elasticity of the element beyond a selected separation, by nature of the fibers being coiled or dispensed in the elastomeric medium at an angle, for example. In another embodiment, metal plates are interleaved with the elastomer to economically achieve the desired mechanical characteristics. The first plate 18 is configured to be bolted to a floor, and the second plate 16 is configured to be bolted to the flange 26.

Figure 2D:
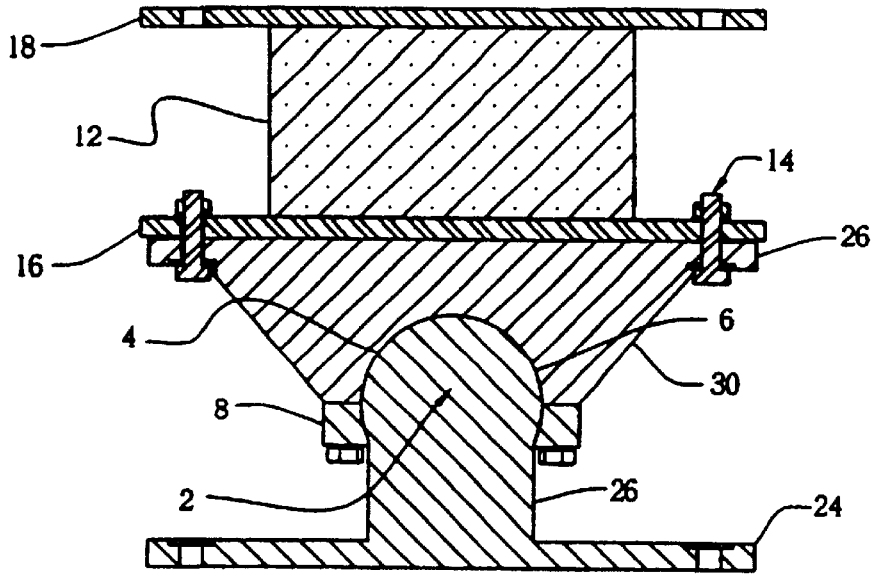
FIG. 2D is a cross section of a seismic isolation device according to an embodiment of the present invention illustrating cast joint halves.

FIG. 2D is a simplified cross section of the seismic isolation device shown in FIG. 2A through the center line 5 of FIG. 2A illustrating the one-piece (e.g. cast) nature of each of the two halves of the joint member.

The thickness and mechanical properties of the elastomeric element are chosen according to the design displacement of the building and foundation, among other factors. Design displacement is the amount of lateral ground movement that occurs during an earthquake of specified type and magnitude. The Structural Engineers Association of California provides techniques for determining the design displacement, depending on several building site criteria. For purposes of illustration, a design displacement of 127 mm (5 in.) will be used.

Figure 3:
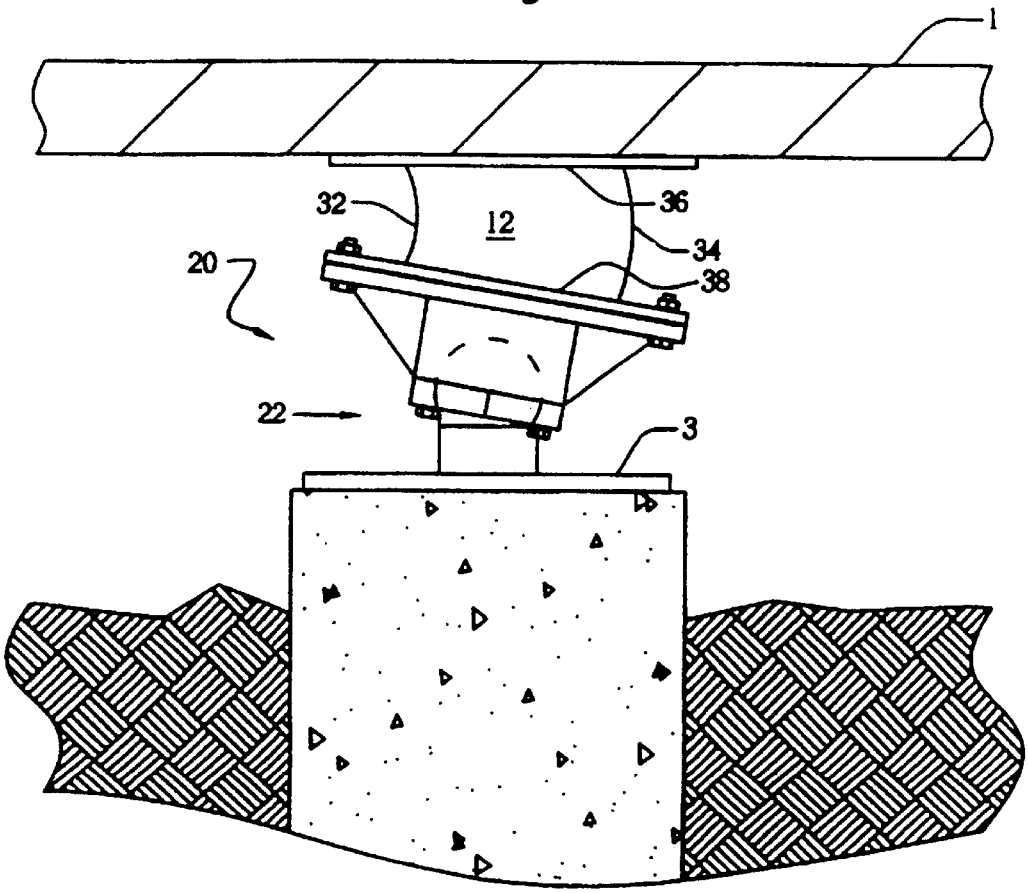
FIG. 3 is a simplified side view of a seismic isolation device according to an embodiment of the present invention responding to a transverse displacement of a foundation pad with respect to a floor.

FIG. 3 is a simplified side view of a seismic isolation device 20, as described above, attached to a foundation pad 3 that is laterally displaced from the original location of the floor beam 1. The joint member 22 tilts in response to the displacement, and the elastomeric element 12 stretches along one edge 32, compresses along another edge 34, and shears between its faces 36, 38 in response to the displacement while allowing the floor to remain essentially level. The bowing of the tensile and compressive faces is shown for purposes of illustration only, and the actual deformation of the elastomeric element in response to a lateral displacement may be different. The shear deformation required in the elastomeric element in response to the lateral displacement is reduced because of the articulation of the joint member. Similarly, the stretching and compression of the elastomeric element use the elastomeric element more efficiently than a conventional elastomeric bearing designed to shear but having intentionally reduced axial elasticity. The multi-axial deformation of the elastomeric element provides additional design flexibility in the selection of materials and the dimensions of the element over conventional bearings. Additionally, the deformed elastomeric element provides a restoring force attempting to re-align the floor to its original relationship with the foundation pad.

Figure 4:
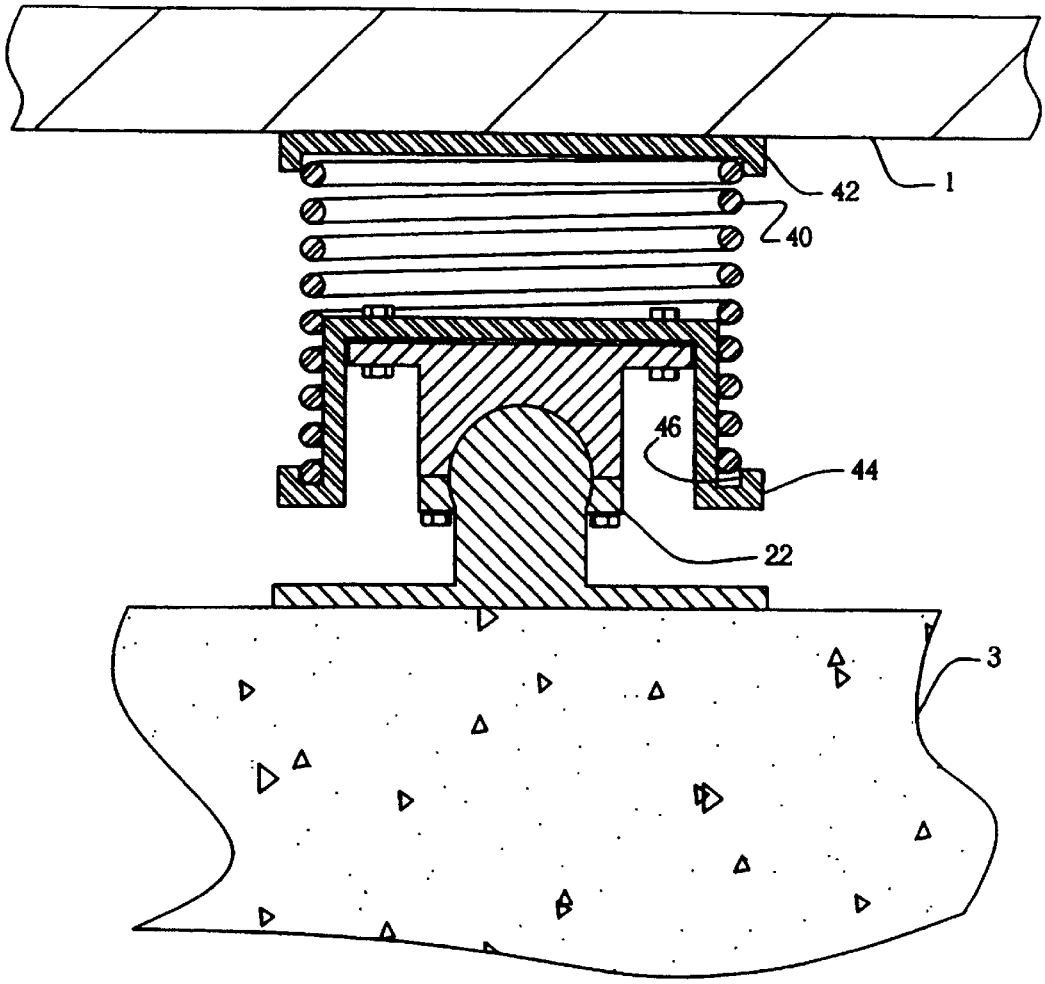
FIG. 4 is a simplified side view of a seismic isolation device according to another embodiment of the present invention.

FIG. 4 is a cross section of another embodiment of the present invention. A metal coil spring 40, rather than an elastomeric element, serves as an elastic element to couple the floor beam 1 to the joint member 22, rather than the elastomeric element shown in FIG. 2A. The metal coil spring accommodates deflection in the horizontal plane, as well as accommodating vertical displacement. Such deflection or displacement results in a restoring force. As with the elastomeric element described above, the joint articulates in response to a lateral displacement so that the spring stretches along one edge and compresses along another, as well as shearing, the shearing being less than the lateral displacement. The metal coil spring 40 is attached to upper and lower spring cups 42, 44 by clips or by welding (not shown), for example, or held in place by the applied weight from the floor beam in conjunction with restraints 46 formed in the spring cups. The mechanical characteristics of the spring are chosen according to design criteria as provided above. The wire dimension and stiffness, material, diameter of the coil, and number of coils may be varied to achieve the desired spring characteristics. Steel alloy is a suitable material for the spring wire in some applications. The lower spring cup is recessed so that the spring end extends beyond a center of rotation (not shown) of the joint. This allows the spring to be longer without requiring additional space between the joint and the floor beam. In a further embodiment, the clearance between the lower spring cup and the foundation pad 3 is selected to limit tilting motion of the spring. Furthermore, the diameter of the lower spring cup may be selected to limit shear displacement of the overlapping (lower) coils, thus maintaining a portion of the spring generally along a center axis of the spring and resting un-coiling in response to a seismic event.

Figure 5:
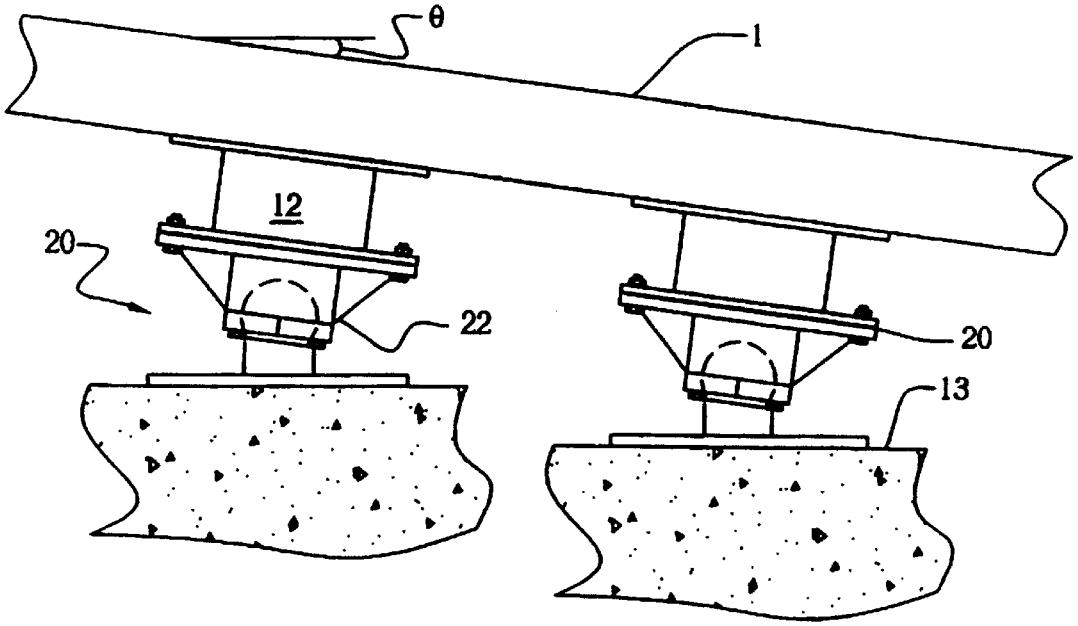
FIG. 5 is a simplified illustration showing seismic isolation devices according to an embodiment of the present invention accommodating a vertical displacement of two foundation pads.

FIG. 5 is a simplified side view of a floor 1 attached to seismic isolation devices 20 mounted on foundation pads 3, 13. For purposes of illustration, relative heights and tilting angles are exaggerated and are not to scale. One foundation pad 3 has been elevated with respect to the other foundation pad 13, thus tilting the floor through an angle θ. The elevation is the result of an earthquake wave or ground settling, for example. In such an instance the joint of the device accommodates the tilting of the floor. The elastomeric element 12 may deform to accommodate a change in spacing between the rotational centers of the joints as a result of the vertical displacement. Furthermore, incidental shear in the elastomeric element may occur due to the transverse loading arising from the tilt. The use of foundation pads rather than a rigid perimeter foundation, for example, allows independent vertical motion of the pads and hence the isolation devices. Additionally, if the vertical displacement is permanent, as may occur with settling, the floor may be leveled by jacking the floor up and inserting shims between the floor and foundation pad with the greater separation.

While the above invention has been described in terms of particular embodiments and applications, those of ordinary skill in the art will realize that modifications to the embodiments can be made within the scope of the invention, and that specific materials and dimensions are provided only as examples. Accordingly, while the invention has been explained in terms of a ball-and-socket joint, other types of joints may be substituted in other instances. Similarly, the elastic element could be a spring, for example, instead of an elastomeric element, or be an elastomeric element with an oval or other cross-section. These equivalents and alternatives are intended to be included within the scope of the present invention. Other variations will be apparent to persons of skill in the art. Accordingly, it is not intended to limit the invention except as provided in the appended claims.

What is claimed is:

1. A device for supporting a structure on a foundation, the device comprising:

a joint assembly allowing rotation of a joint about an axis parallel to a floor of the structure; and an elastic element coupled to the joint assembly, the joint assembly and the elastic element being configured to be attached to each of the structure and the foundation, wherein a lateral displacement of the structure relative to the foundation would cause a rotation of the joint about the axis in addition to an elongation of the elastic element along a first edge, and a compression of the elastic element along a second edge.

2. The device of claim 1 wherein the lateral displacement of the structure relative to the foundation further causes a shear displacement in the elastic element, the shear displacement being less than the lateral displacement.

3. The device of claim 1 wherein the joint is a ball and socket joint.

4. The device of claim 3 further comprising a friction-reducing element disposed between a ball and a socket of the ball and socket joint.

5. The device of claim 1 wherein the elastic element comprises an elastomeric element.

6. The device of claim 5 wherein the elastomeric element comprises an elastomeric material with a lateral shear stiffness of about 490 kg/cm and has a lateral displacement of at least about 4.5 cm.

7. The device of claim 1 wherein the elastic element comprises a metal coil spring.

8. A device for supporting a structure on a foundation, the device comprising:

a joint assembly allowing rotation of a ball and socket joint about an axis parallel to a floor of the structure, the joint assembly having a base for mounting the joint assembly to either of the structure or the foundation, a neck supporting the ball a selected distance from the base to allow rotation of the joint through a selected angle, a socket fixably rotatably attached to the ball, and a flange supporting the socket and connected to an elastic member having a first mounting plate coupled to the flange and a second mounting plate separated from a the first mounting plate by an elastomeric body, the elastomeric body having a lateral shear stiffness of about 490 kg/cm and a lateral displacement of about 4.5 cm, wherein a lateral displacement of the structure relative to the foundation would cause a rotation of the joint about the axis in addition to an elongation of the elastomeric body along a first edge, and a compression of the elastomeric body along a second edge.

9. A foundation system for a building, the system comprising:

a first foundation pad;

a first seismic isolation device mounted between the first foundation pad and a floor of the building, the seismic isolation device having a joint and an elastic element coupled to the joint such that transverse motion of the first foundation pad with respect to the floor causes a rotation of the joint in conjunction with elongation of the elastic element along a tensile edge and compression of the element along a compressive edge;

a second foundation pad separated from the first foundation pad by a portion of earth; and a second seismic isolation device having a second joint, the second seismic isolation device being mounted between the second foundation pad and the floor of the building, wherein a vertical displacement of the first foundation pad with respect to the second foundation pad causes the joint of the first seismic isolation device and the second joint of the second seismic isolation device to rotate through an angle.

10. The foundation system of claim 9 wherein the first foundation pad is a piling.

11. The system of claim 9 wherein the portion of earth includes a section of meta-stable ground.

* * * * *